US005435701A

United States Patent [19]

Markerink

[11] Patent Number: 5,435,701

[45] Date of Patent: Jul. 25, 1995

[54] PUMP WITH MEDIUM TIGHT SHELL AND VENTING MEANS

[75] Inventor: Nico G. Markerink, Hengelo, Netherlands

[73] Assignee: Stork Pompen B.V., Netherlands

[21] Appl. No.: 182,486

[22] Filed: Jan. 14, 1994

[30] Foreign Application Priority Data

Jan. 14, 1993 [NL] Netherlands ..... 9300074
Aug. 4, 1993 [NL] Netherlands ..... 9301360

[51] Int. Cl.[6] ..... F04B 17/00; F04B 39/02; F04B 39/00

[52] U.S. Cl. ..... 417/357; 417/370; 417/420; 417/366; 417/435

[58] Field of Search ..... 417/357, 369, 370, 420, 417/366, 435

[56] References Cited

U.S. PATENT DOCUMENTS

| | | | |
|---|---|---|---|
| 2,687,695 | 8/1954 | Blom et al. . | |
| 2,939,399 | 6/1960 | Rutschi | 417/357 |
| 2,994,795 | 8/1961 | Cattabiani | 417/369 |
| 3,280,750 | 10/1966 | White | 417/357 |
| 4,013,053 | 3/1977 | Dinkelkamp et al. . | |
| 4,416,586 | 11/1983 | Diederich et al. | 417/370 |
| 4,871,301 | 10/1989 | Buse . | |
| 5,038,891 | 8/1991 | Wallis . | |
| 5,248,245 | 9/1993 | Behnke et al. | 417/420 |

FOREIGN PATENT DOCUMENTS

| | | | |
|---|---|---|---|
| 1152344 | 6/1956 | France | 417/370 |
| 9116052 | 4/1992 | Germany . | |
| 0593200 | 9/1984 | Japan . | |
| 0563775 | 8/1944 | United Kingdom . | |
| 0647427 | 8/1950 | United Kingdom . | |
| 0869781 | 6/1961 | United Kingdom . | |
| 1455168 | 11/1976 | United Kingdom . | |
| 2263312 | 7/1993 | United Kingdom . | |

*Primary Examiner*—Richard A. Bertsch
*Assistant Examiner*—Ted Kim
*Attorney, Agent, or Firm*—Webb Ziesenheim Bruening Logsdon Orkin & Hanson

[57] ABSTRACT

A pump (1) includes a pumphouse (2) having an inlet (3) for admitting a medium at a suction side of the pump and an outlet (4) for discharching the medium at a delivery side of the pump. A pumping device is rotatably arranged on an axle (6), the axle being driven by a driver including a rotor and a device for coupling energy to the rotor. A medium tight shell (11) is arranged around the rotor and the axle; and a first canal (18) extends from a first location at a level near or beyond an axial bearing to a second location (24) in the pump where a lower pressure is dominant than at the first location.

20 Claims, 3 Drawing Sheets

PUMP WITH MEDIUM TIGHT SHELL AND VENTING MEANS

BACKGROUND OF THE INVENTION

Pumps for use with poisonous, inflammable, expensive and/or environmentally unfriendly liquids as pumping medium can be constructed to be substantially completely leakproof due to the axle on which the pump fan or impeller is fixed being arranged in a medium tight shell.

In many known pumps it is important, for cooling and lubrication purposes, that the axle bearings lie in the flow of the medium to be pumped. For example, when a pump has been stationary for some time, gas and air bubbles can congregate at certain places in the pump, which leads to insufficient cooling and/or lubrication, as well as increased wear, of the bearings.

In British patent specification GB-A-869781 a fuel pump is disclosed which is to be mounted in a normally submerged position within a fuel tank, e.g. in the wing of an aircraft. The stator of an electric motor, which drives a rotor which is operatively connected to an axle of the impeller, is enclosed in a tube or shell for sealing this stator from the fuel. The rotor is also enclosed in a medium tight package or shell, so that the safety of operation of the pump is secured. The pumphouse or casing is provided with a vent at the upper end thereof for discharging air, vapor and fuel into the interior of the tank in which the pump is disposed. Maintenance of the electric motor is difficult or even impossible. Any bearing for the axle will deteriorate in a relatively short period of time because of increased wear due to lack of lubrication and cooling thereof.

In German Gebrauchsmuster DE-U-9116052 a pump is disclosed, in which a rotor part operatively connected to the axle for the impeller is provided with first magnetic elements which are coupled to second magnetic elements. The second magnetic elements are driven by a driving motor and provide for movement of the first magnetic elements and the axle. A fluid tight shell is provided between the first and second magnetic elements. To achieve a sufficient cooling and lubrication of the bearings of the axle, an additional booster pump member is disposed onto the same axle as for the main impeller.

SUMMARY OF THE INVENTION

The present invention provides a pump for pumping medium, comprising:

- a pumphouse;
- a pumphouse inlet for admitting the medium at the suction side of the pump;
- a pumphouse outlet for discharging the medium at the delivery side of the pump;
- a pump member, disposed on an axle which is rotatably and substantially vertically arranged by one ore more bearings;
- driving means for driving said axle and said pump member, said driving means including a rotor part;
- a medium tight shell arranged around the shaft; and
- at least one gas discharge canal for discharching gaseous medium and for preventing liquid pumping medium to escape, said canal extending to a location at a level near or above the uppermost axle bearing.

The pump according to the present invention is leakproof and has a relatively simple construction. Further it is prevented that air and/or gas bubbles congregate near the upper end of the axle, which would lead to an insufficient lubrication and/or cooling of at least the uppermost bearing as it would be impossible for the bubbles to escape upwardly due to the presence of the shell.

Preferably the pump is provided with coupling means comprising first magnet elements which are part of an inner rotor and an outer rotor operatively connected to the driving means, said outer rotor being provided with second magnetic elements and wherein the shell is positioned between the inner and outer rotors and the bearing and the canal is arranged within the space enclosed by the shell.

According to this preferred embodiment of the present invention, maintenance of the driving means on the outside of the shell can be done relatively easily as such parts are not in contact with the medium to be pumped. Sufficient cooling and lubrication of the bearings of the axle is ascertained.

Further preferably a pump is provided wherein the canal extends within a stationary housing part to a position near to a bearing part. According to this preferred embodiment the canal extends into the space enclosed by the shell, which remains medium tight without any holes or bores therethrough.

During filling or start-up of the pump, gaseous medium is to be discharged while liquid pumping medium is to be prevented from escaping into the environment or being lost. Although the gas discharge canal can be connected to any location in the pump construction where lower pressure dominates than at a location near the uppermost axle bearing, at least during start-up or filling with substantially liquid pumping medium of the pump, e.g. at some location in a line towards the inlet or extending from the outlet, it is preferred that valve means are connected to the canal for allowing gas and air bubbles to escape to the atmosphere or a so called flare and for closing such valve means as soon as liquid pumping medium reaches the valve means. Preferably the valve means are provided with a floater for automatically operating such valve means.

BRIEF DESCRIPTION OF THE DRAWINGS

Further advantages, features and details of the present invention will become clear from the following description and drawings, which show.

DETAILED DESCRIPTION OF THE DRAWINGS

Figure 1:
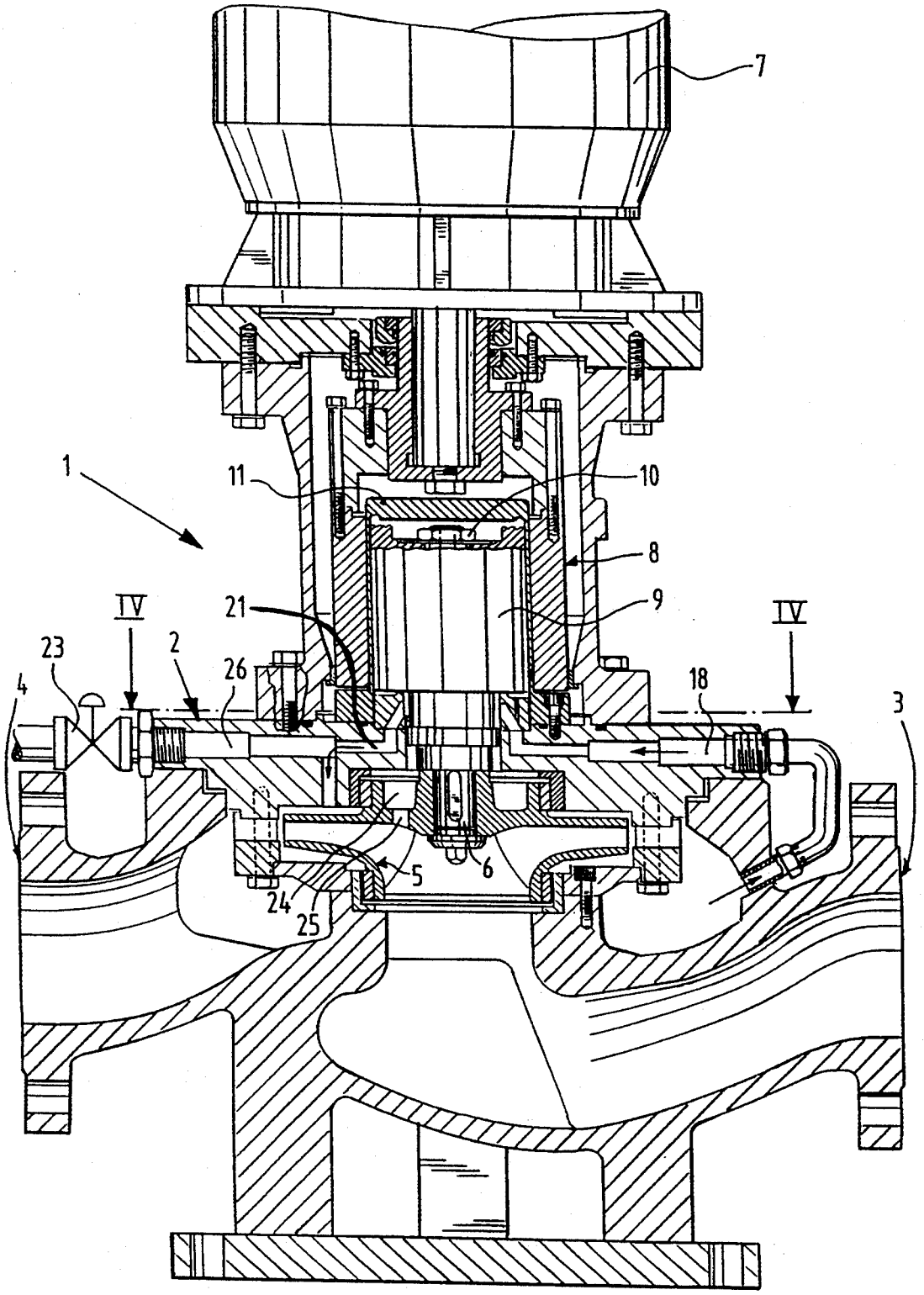
FIG. 1 is a sectional view of a preferred embodiment of the pump according to the present invention.

A pump 1 (FIG. 1) comprises a pumphouse 2 provided with an inlet 3 and an outlet 4. A fan 5 is secured to an axle 6 which, with the aid of magnetic coupling means is driven by a driving motor 7. The magnetic coupling means are formed by an outer rotor 8, which is driven by the driving motor 7 and an inner rotor 9 on which the axle 6 is secured with the aid of a nut 10 on a threaded end thereof. Between the inner rotor 8 and the outer rotor 9, which are both provided with magnet elements, is arranged a shell or pot 11 which is secured to the pumphouse 2 at its open end and on which a cylindrical wall extends between the inner and outer rotors.

Figure 2:
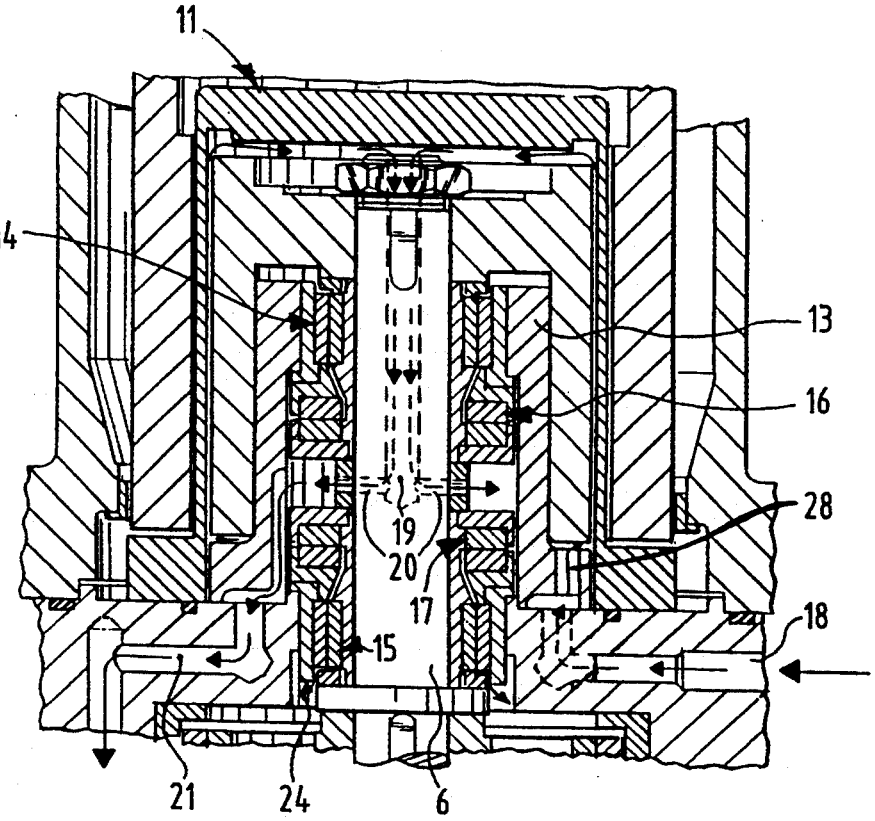
FIG. 2 is a sectional view across line II—II in FIG. 4 is in a normal working state of the pump in FIG. 1.
Figure 3:
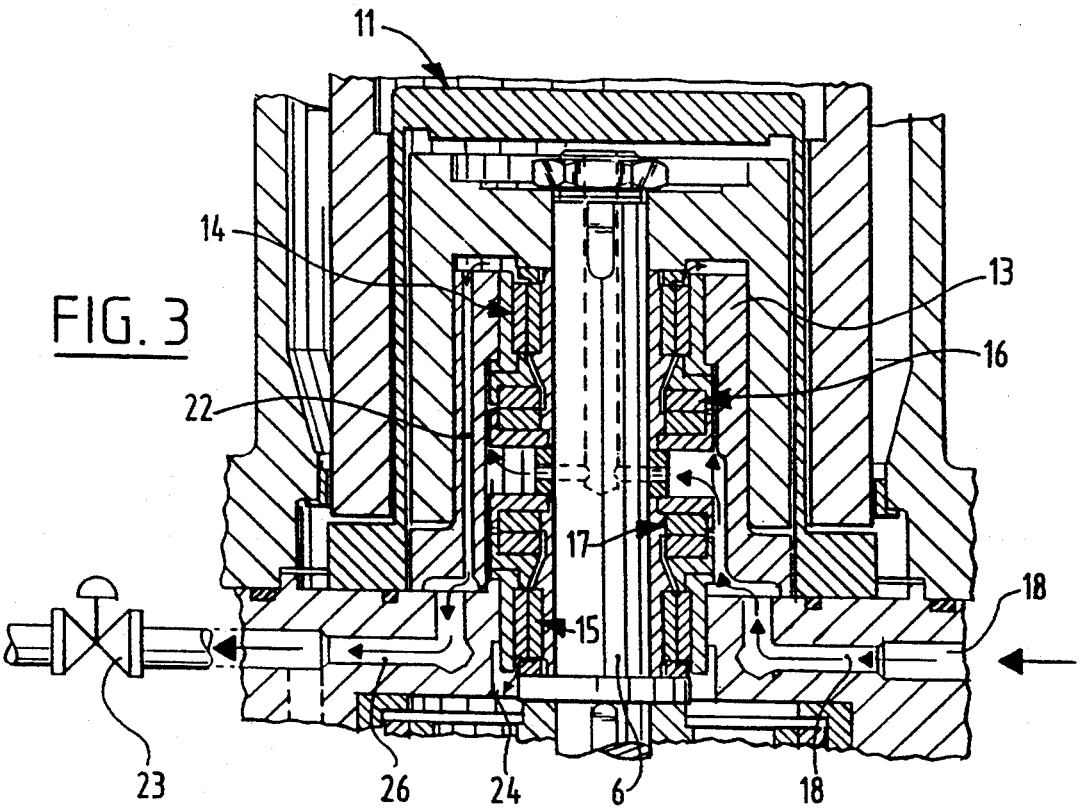
FIG. 3 is a sectional view across line III—III in FIG. 4 during ventilation of the pump.

An axle 6 (FIGS. 2 and 3) is pivotally mounted with the aid of upper and lower radial bearings 14 and 15 respectively, and upper and lower axial bearings 16 and 17 respectively, relative to a housing part 13 which is joined, for example, via a pump lid, to the pumphouse 2, and is thus fixed stationary whereby in the present embodiment the axial bearings are between the radial bearings.

Figure 4:
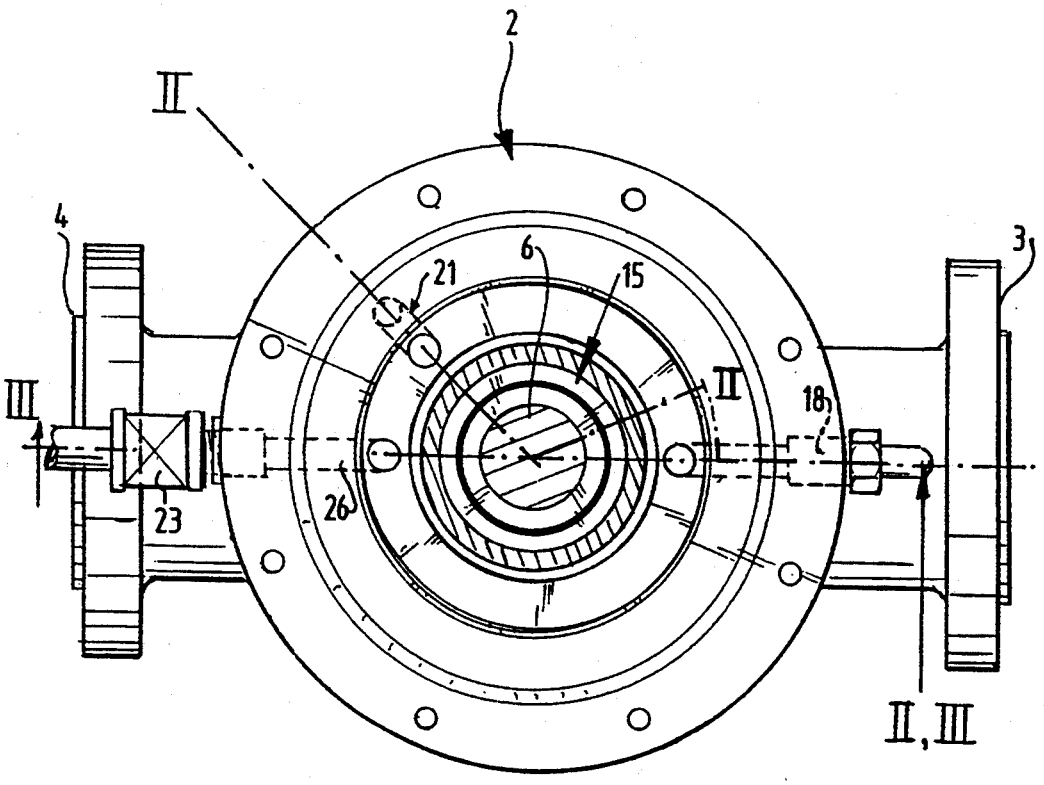
FIG. 4 is a sectional view across line IV—IV in FIG. 1.

Part of the flow from the medium to be pumped is led from the delivery side of the pump (see FIGS. 1, 2 and 4), via canal 18 and diversion 28, along the diverse bearings in the space enclosed by the shell 11. For this object, axle 6 is provided with an inner central canal 19 and one or more transverse canals 20 extending therein transversely. The part of the flow that is used for cooling and lubricating the bearings 13–17 is circulated and forced through said bearings via canal 21, which leads out into a space between the pump lid and the fan where a lower pressure dominates then in canal 18. The flow also circulates along the lower bearings 15 into an annular space 24 which is linked to an inner central fan space via an opening 25 where consequently a lower pressure dominates than in canal 18.

On opening a valve 23 in canal 26 (FIG. 3), the whole space in the shell 11 is sufficiently and quickly ventilated, or freed from gas, by means of the pressurized medium via canal 18. In order that the upper part of this space, under the shell 11, is sufficiently and quickly ventilated, a canal 22 in the stationary housing part 13 is provided that leads out at a level near to or above the upper bearing 14 and which extends substantially parallel with the axle 6 into the canal 26. The valve 23 can be closed automatically, for example with the aid of a floater, or can be closed manually in refinery applications a so-called flare, wherein the gasses are burned, can be used to prevent environmentally unfriendly substances escaping into the atmosphere. In the embodiment, shown and described, the gas discharge canal 26 extends substantially parallel for somewhat oblique relative to the axle in housing part 13 disposed in the interior of the space enclosed by the shell 11. In another embodiment not shown, one or more gas discharge canals can be disposed in or along the inner wall of the shell itself.

Another non-limitive variation of the embodiment shown relates to canal 26 debouching to some location in a line extending from the pump outlet where at start-up of filling of the pump a low pressure is dominant, such as at relatively high level above a groundlevel.

The present invention is not limited to the inventive embodiment herein described and drawn.

I claim:

1. A pump comprising:

a) a pumphouse having a pumphouse inlet for admitting a medium at a suction side of said pump and having a pumphouse outlet for discharging the medium at a delivery side of said pump;

b) a pump member disposed on an axle, wherein said axle is rotatably and substantially vertically arranged by at least one bearing;

c) driving means for driving said axle and said pump member, said driving means including a rotor part;

d) a medium tight shell arranged around said axle;

e) at least one discharge canal arranged within a space enclosed by said medium tight shell and extending to a location at a level near an uppermost one of said axle bearings; and f) means for venting said discharge canal positioned below said medium tight shell and coupled to said discharge canal.

2. The pump according to claim 1, further including coupling means having first magnet elements which are part of an inner rotor and an outer rotor operatively connected to said driving means, said outer rotor being provided with second magnetic elements and wherein said shell is positioned between said outer rotor and said bearings.

3. The pump according to claim 2, wherein said discharge canal extends within a stationary housing part to a position near to one said bearing.

4. The pump according to claim 2, wherein said venting means includes a further canal and a valve means wherein said discharge canal is coupled with said further canal which extends out of said pumphouse and wherein said valve means are coupled to said further canal and arranged for allowing said discharge canal to vent to the atmosphere.

5. The pump according to claim 2, wherein said pump member is disposed at a lower end of said axle.

6. The pump according to claim 2, wherein said venting means includes a valve means operatively connected to said discharge canal.

7. The pump according to claim 1, wherein said discharge canal extends within a stationary housing part to a position near to one said bearing.

8. The pump according to claim 7, wherein said venting means includes a further canal and a valve means wherein said discharge canal is coupled with said further canal which extends out of said pumphouse and wherein said valve means are coupled to said further canal and arranged for allowing said discharge canal to vent to the atmosphere.

9. The pump according to claim 7, wherein said venting means includes a valve means operatively connected to said discharge canal.

10. The pump according to claim 1, wherein said venting means includes a further canal and a valve means wherein said discharge canal is coupled with said further canal which extends out of said pumphouse and wherein said valve means are coupled to said further canal and arranged for allowing said discharge canal to vent to the atmosphere.

11. The pump according to claim 10, wherein said pump member is disposed at a lower end of said axle.

12. The pump according to claim 1, wherein said pump member is an impeller.

13. The pump according to claim 1, wherein said discharge canal is disposed adjacent an interior of said shell.

14. The pump according to claim 1, further including valve means operatively connected to said discharge canal.

15. The pump according to claim 1, wherein said pump member is disposed at a lower end of said axle.

16. The pump according to claim 1, wherein said pump member is a fan.

17. The pump according to claim 1, wherein said discharge canal is disposed adjacent an interior of said shell.

18. A pump comprising:

a pump housing having a pumping chamber, an inlet coupled to said pumping chamber for admitting a medium at a suction side of said pump, and an outlet coupled to said pumping chamber for discharging the medium at a discharge side of said pump;

a pump member rotatably supported within said pump chamber;

a rotatable, substantially vertically arranged axle having said pump member coupled to one end thereof;

at least one bearing rotatably supporting said axle; driving means for driving said axle and said pump member, said driving means including a rotor part;

a solid shell coupled to said pump housing, said shell surrounding said axle;

a stationary housing part positioned within said shell and joined to said pump housing, wherein said stationary housing part supports said at least one bearing which rotatably supports said axle; and at least one discharge means for discharging gaseous medium and for preventing pumping medium from escaping from said pump, said discharge means including a first discharge canal positioned within said stationary housing part extending from a location at a level near an uppermost one of said bearings and extending to a second discharge canal positioned in said pump housing, where said second discharge canal extends below said medium tight shell, said second discharge canal extending out of said pump housing to a valve means.

19. The pump of claim 18, further including a supply canal extending from said delivery side of said pump in said pumphouse to a diversion canal positioned in said stationary housing part, said diversion canal extending from said supply canal to an open space formed adjacent the interior of said shell, said open space extending to an upper end of said axle, said axle including an inner central canal in fluid communication with said open space and said axle including one or more transverse canals extending from said inner central canal to a periphery of said axle.

20. A pump comprising:

a) a pumphouse having a pumphouse inlet for admitting a medium at a suction side of said pump and having a pumphouse outlet for discharging the medium at a delivery side of said pump;

b) a pump member disposed on an axle, wherein said axle is rotatably and substantially vertically arranged by at least one bearing;

c) driving means for driving said axle and said pump member, said driving means including a rotor part;

d) a medium tight shell arranged around said axle;

e) at least one discharge canal arranged within a space enclosed by said medium tight shell and extending to a location at a level above an uppermost one of said axle bearings; and f) means for venting said discharge canal positioned below said medium tight shell and coupled to said discharge canal.

* * * * *